US005316306A

United States Patent [19]

Cody

[11] Patent Number: 5,316,306

[45] Date of Patent: May 31, 1994

[54] GOLF SWING TRAINING DEVICE

[76] Inventor: Douglas R. Cody, 2008 Deerpark Dr. #339, Fullerton, Calif. 92631

[21] Appl. No.: 75,668

[22] Filed: Jun. 11, 1993

[51] Int. Cl.[5] ..... A63B 69/36

[52] U.S. Cl. ..... 273/196.2; 273/193 B; 273/58 C

[58] Field of Search ..... 273/193 R, 193 A, 193 B, 273/194 R, 194 A, 194 B, 186.2, 80 B, 58 C

[56] References Cited

U.S. PATENT DOCUMENTS

| | | | |
|---|---|---|---|
| 1,471,794 | 10/1923 | Leven | 273/193 R |
| 1,662,712 | 3/1928 | Mensing | 273/80 B |
| 1,930,342 | 10/1933 | Graham | 273/193 R |
| 2,396,408 | 3/1946 | Benecke | 273/186.2 |
| 2,462,955 | 3/1949 | Glancey | 273/186.2 X |
| 3,428,325 | 2/1969 | Atkinson | 273/186.2 |
| 4,343,473 | 8/1982 | Laursen | 273/186 A |
| 4,541,631 | 9/1985 | Sasse | 273/170 |
| 4,602,788 | 7/1986 | Wendt | 273/193 A |
| 4,982,963 | 1/1991 | Fazio et al. | 273/186.2 |
| 5,026,063 | 6/1991 | Rhodes | 273/186 A |
| 5,083,790 | 1/1992 | Wheatley | 273/193 A |

*Primary Examiner*—George J. Marlo

[57] ABSTRACT

A golf swing training apparatus is provided for generally improving a golfer's golf club swing technique. A rigid hand grip is connected to one end of a flexible, tubular shaft. The other end of the shaft is connected to a ball. The device has a required overall length as to just fit between a vertical aligned with the outside of one arm of the golfer, the arm resting at the golfer's side, and the wrist of the golfer's other arm when the other arm and hand are jointly stretched horizontally. A threaded shaft-length adjustment connector is included at a point along the shaft for adjusting the overall length of the shaft. In use, the overall length, the flexibility of the tube, and the weight of the ball combine to result in a swing action such that on each correctly executed backswing the ball gently touches one side of the golfer just below the golfer's other arm. Likewise, on each correctly executed foreswing follow-through, the ball gently touches the other side of the golfer just below the one arm of the golfer. However, on each incorrectly executed backswing or foreswing, the ball touches the golfer contrariwise, either more forcefully or less forcefully than with a correctly executed swing, so that the golfer receives a tactile feedback indication of the correctness of each swing and is thus able to improve swing technique.

5 Claims, 3 Drawing Sheets

GOLF SWING TRAINING DEVICE

FIELD OF THE INVENTION

This invention relates generally to sports training devices, and, more particularly, to a training device for improving a golfer's golf swing technique.

BACKGROUND OF THE INVENTION

Weighted golf club training devices are well known in the prior art. For example, U.S. Pat. No. 5,026,063 to Rhodes on Jun. 25, 1991, discloses a golf club with a shaft having at one end a hand grip, and at the other end having a weight. Such a device is swung by a golfer in a conventional way, whereby the weighted end causes the shaft to flex considerably more than a conventional golf club would. Such flexing of the shaft results in an exaggerated tactile feel, giving the golfer an improved awareness of the feel of a proper golf swing. Miyamoto, in his U.S. Pat. No. 4,118,033 issued on Oct. 3, 1978, discloses a similar device, as does Atkinson in his U.S. Pat. No. 3,428,325 issued on Feb. 18, 1969. Such devices, while perhaps well suited to certain golf club swinging styles and golfers, do not account for an optimized shaft flexibility and length. Indeed, the flexible shaft of the Atkinson device is designed to stretch to varying lengths during the swing.

An improved device, taught in U.S. Pat. No. 4,602,788 to Wendt on Jul. 29, 1986, includes a stack of weights on the end of a conventional shaft. A retaining means holds the weights in place, and allows for a variable number of weights to be secured to the end of the shaft. As such, the optimal weight for a particular golfer at a particular time in the golfer's skill development may be set on the shaft. Clear advantages are seen in such a device, yet such a device still does not provide for variable shaft length. As such, while an optimal weight may be set for a particular golfer, the shaft length cannot be changed in such a device. Such variable shaft length can be useful when concentrating on and learning particular aspects of the golf swing. Further, such a device has the disadvantage that the rigid weights at the end of the shaft, which may be moving at considerable speeds during a golf swing, may cause injury if striking the golfer or a bystander.

Providing for adjustable shaft length has the advantage of allowing the golfer to set the length of the shaft as to optimize the effectiveness of the device. For example, with the overall length of the device set to just fit between the outside of one arm and the wrist of the extended other arm, and with the shaft flexibility and end weight set accordingly, the end of the club lightly touches the golfer at the backswing and foreswing follow-through of a properly executed golf swing. Clearly, then, there is a need for a golf swing training device that allows for variable shaft length and teaches the proper shaft length for each individual golfer. Such a needed device would allow for relatively quick adjustment, and would provide an optimal shaft flexibility and weight. Further, such a needed device would not cause injury if aggressively contacting another person, and would provide additional feedback means for the golfer. The present invention fulfills these needs and provides further related advantages.

SUMMARY OF THE INVENTION

The present invention is a device for training a golfer for generally improving golf club swing technique. A rigid hand grip is connected to one end of a flexible, tubular shaft. The other end of the shaft is connected to a ball. The device has a required overall length as to just fit between a vertical aligned with the outside of one arm of the golfer, the arm resting at the golfer's side, and the wrist of the golfer's other arm when the other arm and hand are jointly stretched horizontally. A threaded shaft-length adjustment connector is included at a point along the shaft for adjusting the overall shaft length. The overall length, the flexibility of the tube, and the weight of the ball combine to result in a swing action such that on each correctly executed backswing the ball gently touches one side of the golfer just below the golfer's other arm. Likewise, on each correctly executed foreswing follow-through, the ball gently touches the other side of the golfer just below the one arm of the golfer. However, on each incorrectly executed backswing or foreswing, the ball touches the golfer contrariwise, either more forcefully or less forcefully than with a correctly executed swing, so that the golfer receives a tactile feedback indication of the correctness of each swing and is thus able to improve swing technique.

The present invention is a golf swing training device that allows for variable shaft length while providing an optimal weight and shaft flexibility. The present device further allows for relatively quick adjustment of the length of the shaft. Further, the soft ball at the end of the shaft reduces impact shock when it aggressively contacts the golfer, and provides additional feedback means for the golfer. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
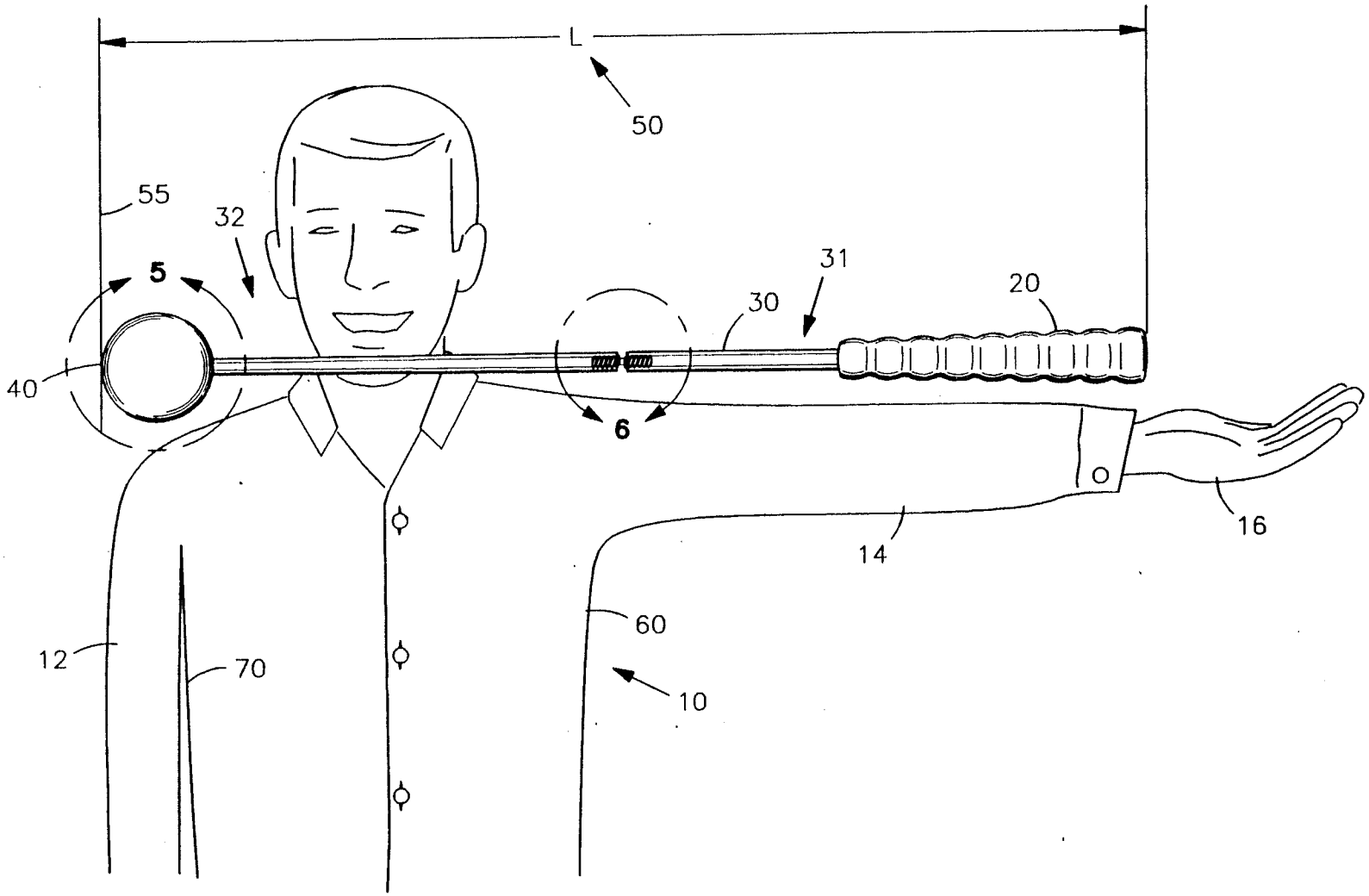
FIG. 1 is a rear elevational view of the invention, illustrating an overall length of the invention in relationship to a golfer using the invention.

FIG. 1 shows a device for training a golfer 10 for generally improving golf club swing technique. A rigid hand grip 20 is connected to one end 31 of a shaft 30 formed from a soft flexible tube. The other end 32 of the shaft 30 is connected to a ball 40. The device has a required overall length "L" 50 as to just fit between a vertical 55 aligned with the outside of one arm 12 of the golfer 10, the one arm 12 resting at the golfer's side, and the wrist of the golfer's other arm 14 when the other arm 14 and hand 16 are jointly stretched horizontally to the other side of the golfer 10 with the hand 16 of the other arm 14 held palm-up, illustrated in FIG. 1. The most effective results have been found with the shaft 30 formed of a ½ inch diameter vinyl tubing of approximately 1/16 wall thickness and having a specific gravity of approximately 1.22 and a Shore "A" hardness of approximately 83. The rigid hand grip 20 is preferably 10½ inches long, and the ball 40 is preferably 4 inches in diameter and manufactured from a resilient foam or rubber material.

Figure 6:
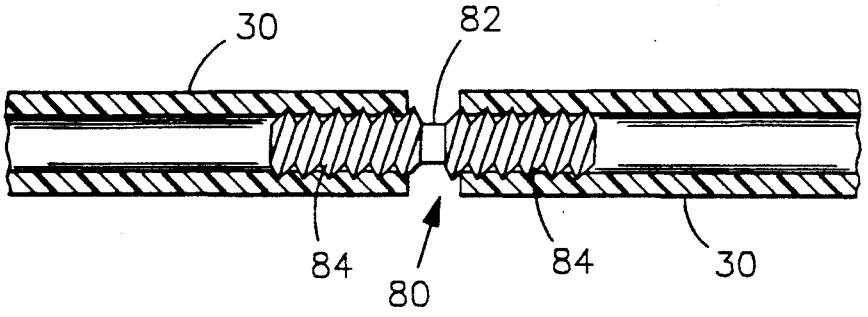
FIG. 6 is a partial cross-sectional view of the invention, taken generally along line 6 of FIG. 1, illustrating in more detail a shaft length adjustment means of the invention.

A shaft length adjustment means 80 is included so that the shaft 30 may be adjusted to the overall required length "L" 50 (FIG. 6). Such an adjustment means 80 preferably includes a connector 82 providing opposing threaded fingers 84 of a diameter so as tightly fit within the flexible tube. As such, with the shaft 30 severed into two colinear portions of adjusted length, the total length of the portions taken together with the handle 20 and the ball 40 is equal to the required overall length "L" 50.

Figure 5:
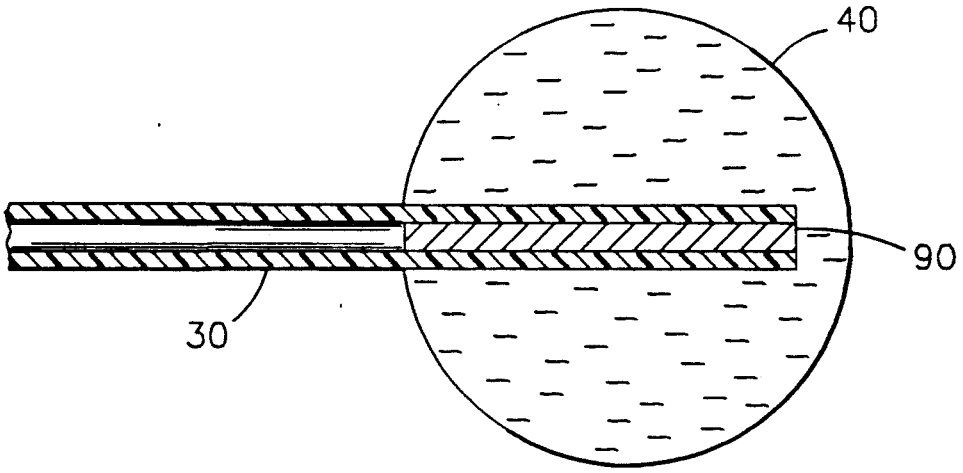
FIG. 5 is a partial cross sectional view of the invention, taken generally along line 5 of FIG. 1, illustrating in more detail a ball of the invention.

Preferably, a rigid dowel rod 90 of approximately 4 inches in length is inserted into the other end 32 of the shaft 30, and the other end 32 of the shaft 30 is inserted into the ball 40, such that rigidity at the other end 32 of the shaft 30 is provided for improved mounting of the ball 40 onto the shaft 30 (FIG. 5).

Figure 4:
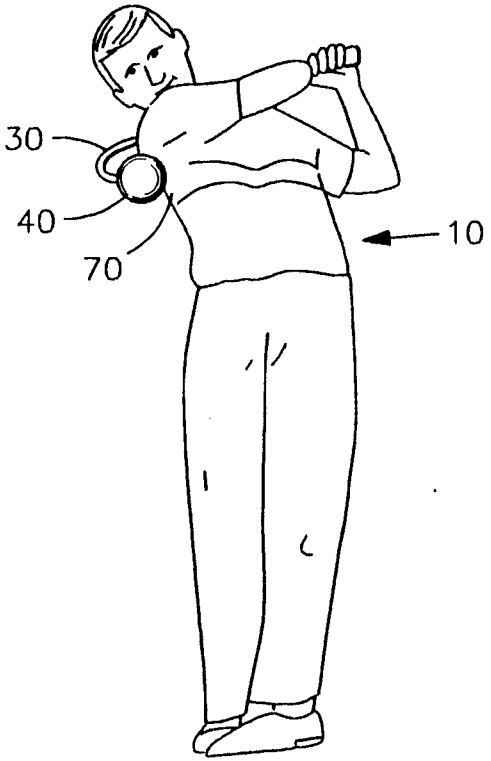
FIG. 4 is a front elevational view of the golfer using the invention in a full foreswing follow through of the invention.
Figure 3:
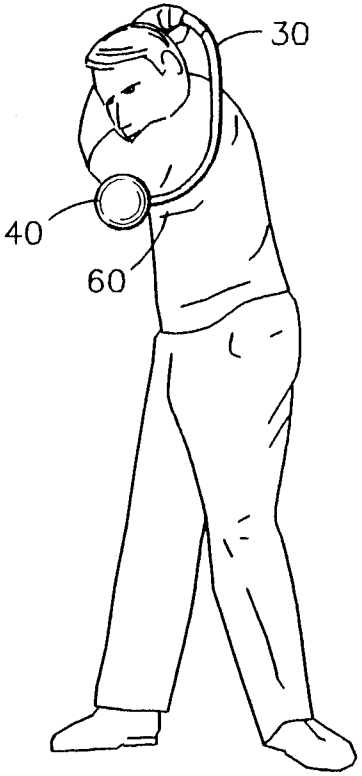
FIG. 3 is a front elevational view of the golfer using the invention in a full backswing of the invention.
Figure 2:
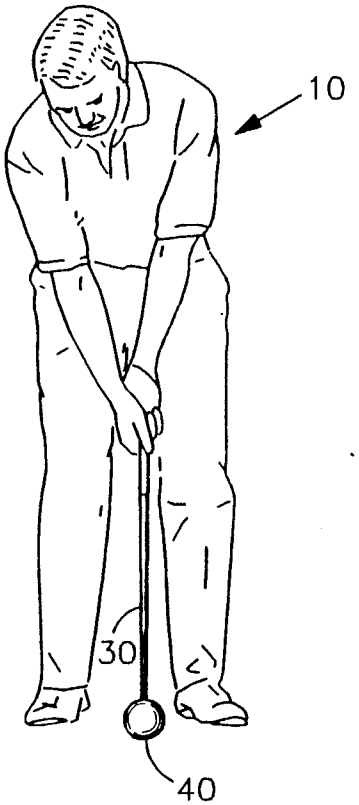
FIG. 2 is a front elevational view of the golfer using the invention as though addressing an imaginary golf ball.

In operation, the shaft 30 extends to a straight linear form for addressing an imaginary golf ball (FIG. 2). The overall length "L" 50, the flexibility of the tube, and the weight of the ball 40 combine to result in a swing action such that on each correctly executed backswing the ball 40 gently touches one side 60 of the golfer 10 just below the golfer's other arm 14 (FIG. 3). Likewise, on each correctly executed foreswing follow-through, the ball 40 gently touches the other side 70 of the golfer 10 just below the one arm 12 of the golfer (FIG. 4). However, on each incorrectly executed backswing or foreswing, the ball 40 touches the golfer 10 contrariwise, either more forcefully or less forcefully than with a correctly executed swing, so that the golfer 10 receives a tactile feedback indication of the correctness of each swing and is thus able to improve swing technique.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. A device for training a golfer for generally improving golf club swing technique, comprising a 10½ inch long rigid hand grip connected to one end of a shaft formed from a soft flexible tube, the other end of the shaft connected to a ball of 4 inches diameter, the device having a required overall length, when the device is held horizontally, being such as to just fit between a vertical aligned with the outside of one arm of the golfer, the one arm resting at the golfers side, and the wrist of the golfer's other arm, when the other arm and hand are jointly stretched horizontally to the other side of the golfer with the hand of the other arm held palm-up, whereby the overall length, the flexibility of the tube, and the weight of the ball combine to result in a swing action such that on each correctly executed backswing the ball gently touches one side of the golfer just below one of the golfer's arms, and on each correctly executed foreswing follow-through the ball gently touches the other side of the golfer just below the other of the golfer's arms, and on each incorrectly executed backswing or foreswing, the ball touches the golfer contrariwise so that the golfer receives a tactile feedback indication of the correctness of each swing and is thus able to improve swing technique.

2. The device for training a golfer for generally improving golf club swing technique of claim 1 further including shaft length adjustment means so that the shaft may be adjusted to said overall length.

3. The device for training a golfer for generally improving golf club swing technique of claim 2 wherein the adjustment means includes a connector providing opposing threaded fingers of a diameter to tightly fit within the flexible tube, such that with the shaft severed into two colinear portions of adjusted length, the total length of the portions taken together with the handle and the ball is equal to the required overall length.

4. The device for training a golfer for generally improving golf club swing technique of claim 1 further including a rigid dowel rod of approximately 4 inches in length, the rod inserted into the end of the shaft, the shaft inserted into the ball for providing rigidity at the terminal portion of the shaft for improved mounting of the ball on the shaft.

5. The device for training a golfer for generally improving golf club swing technique of claim 1 wherein the shaft is formed of a ½ inch diameter vinyl tubing of approximately 1/16 wall thickness and having a specific gravity of approximately 1.22 and a Shore "A" hardness of approximately 83.

* * * * *